US005795060A

United States Patent [19]

Stephens

[11] Patent Number: 5,795,060

[45] Date of Patent: Aug. 18, 1998

[54] METHOD AND APPARATUS FOR CONTINUOUS PRODUCTION OF COLLOIDALLY-MIXED CEMENT SLURRIES AND FOAMED CEMENT GROUTS

[76] Inventor: Patrick J. Stephens, 1276 Chuckanut Dr., Bellingham, Wash. 98225

[21] Appl. No.: 650,921

[22] Filed: May 17, 1996

[51] Int. Cl.[6] ..... B28C 5/08; B28C 7/04

[52] U.S. Cl. ..... 366/2; 366/8; 366/10; 366/16; 366/20; 366/40; 366/51

[58] Field of Search ..... 366/2, 3, 8, 10, 366/13, 16, 17, 20, 30, 34, 33, 40, 42, 51, 64, 66, 152.1, 160.2, 162.2, 318

[56] References Cited

U.S. PATENT DOCUMENTS

| | | | |
|---|---|---|---|
| 3,459,409 | 8/1969 | Goldberger | 366/40 |
| 4,003,431 | 1/1977 | Novotny et al. | 366/17 |
| 4,298,288 | 11/1981 | Weisbrod | 366/16 |
| 4,322,168 | 3/1982 | Hartung et al. | 366/40 |
| 4,778,276 | 10/1988 | Meyer et al. | 366/40 |
| 5,213,414 | 5/1993 | Richard et al. | 366/40 |
| 5,452,954 | 9/1995 | Handke et al. | 366/16 |
| 5,503,473 | 4/1996 | Dearing, Sr. et al. | 366/17 |
| 5,570,953 | 11/1996 | DeWall | 366/10 |

FOREIGN PATENT DOCUMENTS

| | | | |
|---|---|---|---|
| 617862 | 2/1927 | France | 366/16 |
| 2059422 | 12/1970 | Germany | 366/3 |

*Primary Examiner*—Tony G. Soohoo
*Attorney, Agent, or Firm*—Todd N. Hathaway

[57] ABSTRACT

An apparatus for high capacity production of high-fluidity, colloidally mixed cement slurry. Water and cement dust are combined at metered rates by a premixing assembly which discharges into a mixing tub. The high-speed, high-shear pump recirculates the material through the tub to produce the colloidally-mixed slurry. The high-fluidity slurry may be provided to a second pump, preferably of the positive-displacement, progressive-cavity, rotor-stator type, for supplying the slurry at a metered rate. Finished foam material may also be provided to the slurry metering pump at the metered rate, so the materials are mixed to form a foamed cement grout in which the weight and quality of the material is precisely adjustable.

23 Claims, 8 Drawing Sheets

10
12
14
16
18
20
22
30
31
32
34
36
38
42
44
45
46
48
50
51
53
54
55
56
58
60
62
64
66
68
70
80
86a
90
92
94
96
97
103
154
156
158
160
176
180
184
201
220
229
234
242
244
276
278
289
314

80
98
98
86b
86a
22
80
12
84
88
82
88
100
101
26
102
122
28
32
14
98
95
95
96
96
97
94
90
92
182
16
34
158
30
36
42
186
184
46
40
38

208
210
272
276
274
278
242
244
224
222
216
220
174
55
54
234
226
166
50
204
240
176
206
306
212
202
310
312
228
233
304
230
178
53
214
302
232
326
231
231
180
230
229

METHOD AND APPARATUS FOR CONTINUOUS PRODUCTION OF COLLOIDALLY-MIXED CEMENT SLURRIES AND FOAMED CEMENT GROUTS

BACKGROUND OF THE INVENTION a. Field of the Invention

The present invention relates generally to methods and apparatus for the mixing of Portland cements and, more particularly, to a method and apparatus for the high capacity production of high-fluidity pumpable cement slurries.

b. Background

As a preliminary matter, high-fluidity, pumpable Portland cement slurries should be contrasted with the more familiar concrete mixes which are widely used throughout the construction industry. The latter are characterized by a high viscosity and high aggregate content. Typically, large batches of this type of material are prepared at ready-mix plants, and are then transported to the work site via truck. On occasion, these conventional concrete mixes may be pumped over relatively short distances, using piston-type pumps which are capable of dealing with the thick, highly abrasive slurry.

The high-fluidity cement slurries to which the present invention pertains, however, are of a somewhat more specialized nature. These materials are generally free of large amounts of heavy aggregate material and are capable of being pumped over relatively long distances, through conduits or hoses. Although the actual constituents vary to some extent, these slurries usually consist of water/Portland cement mixtures, although they may sometimes include various high-fluidity or chemical additives, such as bentonite, fly ash, and superplasticisers, for example.

In the past, most of the known uses of high-fluidity cement slurries have called for comparatively small quantities of this material. Some exemplary uses have included tunnel liner backfills, tie-back installations, and similar applications, where massive volumes of the material have not been needed. The result is that high-fluidity cement slurries have usually been prepared using manual or low-volume processes/equipment, typically with one or two men breaking open bags of cement-dust and dumping these into mixing tubs. These conventional small-scale mixing techniques are grossly inefficient and exhibit numerous deficiencies. Firstly, the conventional mixing processes are labor-intensive, which adds significantly to the cost of the material. Furthermore, quality control is rudimentary at best, and the water-to-cement ratio, density, and other characteristics of the slurry tend to vary greatly from one batch to the next.

Still further, while these low-capacity systems may have been able to produce enough slurry to supply the relatively low volume jobs which have existed in the past, recently developed uses require volumes which are simply beyond the capacity of manual bag-breaking teams and small tub mixers. For example, foamed cement grouts, which are mixtures of slurry and fininshed foam material, offer great potential as fill materials for large capacity geotechnical work, such as the filling of massive geological voids (e.g., abandoned mines, tunnels, caverns, wash outs, etc.). However, the rate at which the foamed grout must be produced in order for these jobs to be feasible far outstrips the capacity of existing systems to supply the slurry component. Moreover, the slurry must be of consistently high quality; for example, when mixed with foam, improper slurry mixtures can cause water run-off, excessive shrinkage, or collapse of the cellular bubble structure. As a result, the poor or non-existent quality control which is inherent in existing systems is simply not tolerable in such large-capacity operations, where any errors would have a greatly magnified impact.

The above is just one example of the increasing need for high capacity, consistent quality production of cement slurries, and it will be understood that similar requirements have developed or are developing in other parts of the industry.

Accordingly, there exists a need for a method and apparatus which is capable of the rapid production of high-fluidity cement slurries in large quantities, and which is capable of maintaining highly consistent product quality. Moreover, there is a need for such a method and apparatus which permits the slurry mixture (e.g., the water-to-cement ratio) to be precisely adjusted on an ongoing basis, as may be necessary to keep the product within specifications or to meet changing operational conditions or requirements.

SUMMARY OF THE INVENTION

The present invention has solved the problems cited above, and is an apparatus for high-capacity production of high-fluidity cement slurry. Broadly, this comprises means for providing a supply of hydraulic cement dust at an adjustable, metered rate; means for mixing the metered supply of cement dust with the metered supply of water to produce an initial cement slurry having a water-to-cement ratio which is precisely adjustable by adjusting the metered rates at which the water and cement dust are provided thereto; and means for colloidally mixing the initial cement slurry which is produced by the primary mixing means so as to produce a high-fluidity colloidally-mixed hydraulic cement slurry having the precisely adjustable water-to-cement ratio.

Preferably, the means for providing water at an adjustable metered rate comprises a positive displacement pump for delivering the water, the pump having an output rate which is directly proportional to an operating speed thereof, and control means for selectively adjusting the operating speed of a pump so as to adjust for a controlled meter rate at which the water is delivered. The positive displacement pump may be a progressive-cavity, rotor-stator type pump which is driven by a variable speed motor, such as a hydraulic drive motor.

The means for providing a supply to cement dust at an adjustable, metered rate may comprise a hopper assembly for holding a bulk amount of the cement dust, and a metering valve assembly mounted to the hopper assembly for dispensing the cement dust therefrom at the adjustable metered rate. The metering valve assembly may comprise a rotary metering valve for dispensing the cement dust, the metering valve having a rate which is directly proportional to an operating speed thereof, and control means for selectively adjusting the operating speed of the rotary metering valve. The rotary metering valve may be a rotary air lock driven by a variable speed motor.

The means for mixing the metered supply of cement dust with the metered supply of water may comprise a generally horizontally extending mixing assembly comprising a cement dust feed section for receiving the supply of cement dust which is dispensed from the hopper assembly, and a mixing section for receiving the supply of cement dust from the feed section and the supply of water, and for combining the cement dust with the water so as to form the initial cement slurry.

A means for colloidally mixing the initial cement slurry which is produced by the primary mixing means may comprise a tub section into which the initial cement slurry is discharged from the mixing means, and a high-speed, high-shear mixing pump having an intake line for drawing of the slurry from the tub section and a discharge line for returning the slurry to the tub section, so that the colloidal mixing pump recirculates the slurry through the tub section until the high-fluidity colloidally-mixed hydraulic cement slurry is formed.

The apparatus may further comprise means for pumping the high-fluidity, colloidally mixed cement slurry from the colloidal mixing means at an adjustable metered rate. This pumping means may be a positive displacement pump having an output rate which is directly proportional to an operating speed thereof, and control means for selectively adjusting the operating speed of the pump so as to adjustable control the meter rate at which the colloidally mixed slurry is delivered thereby.

Still further, the apparatus may comprise means for providing a supply of finished foam to an intake side of the slurry metering pump at an adjustable, metered rate, so that the colloidally mixed slurry and finished foam are mixed therein to produce the foamed cement grout having a foam-to-slurry, ratio which is precisely adjustable by adjusting the rates at which the colloidally mixed slurry and finished foam are provided.

DETAILED DESCRIPTION a. Overview

Figure 1:
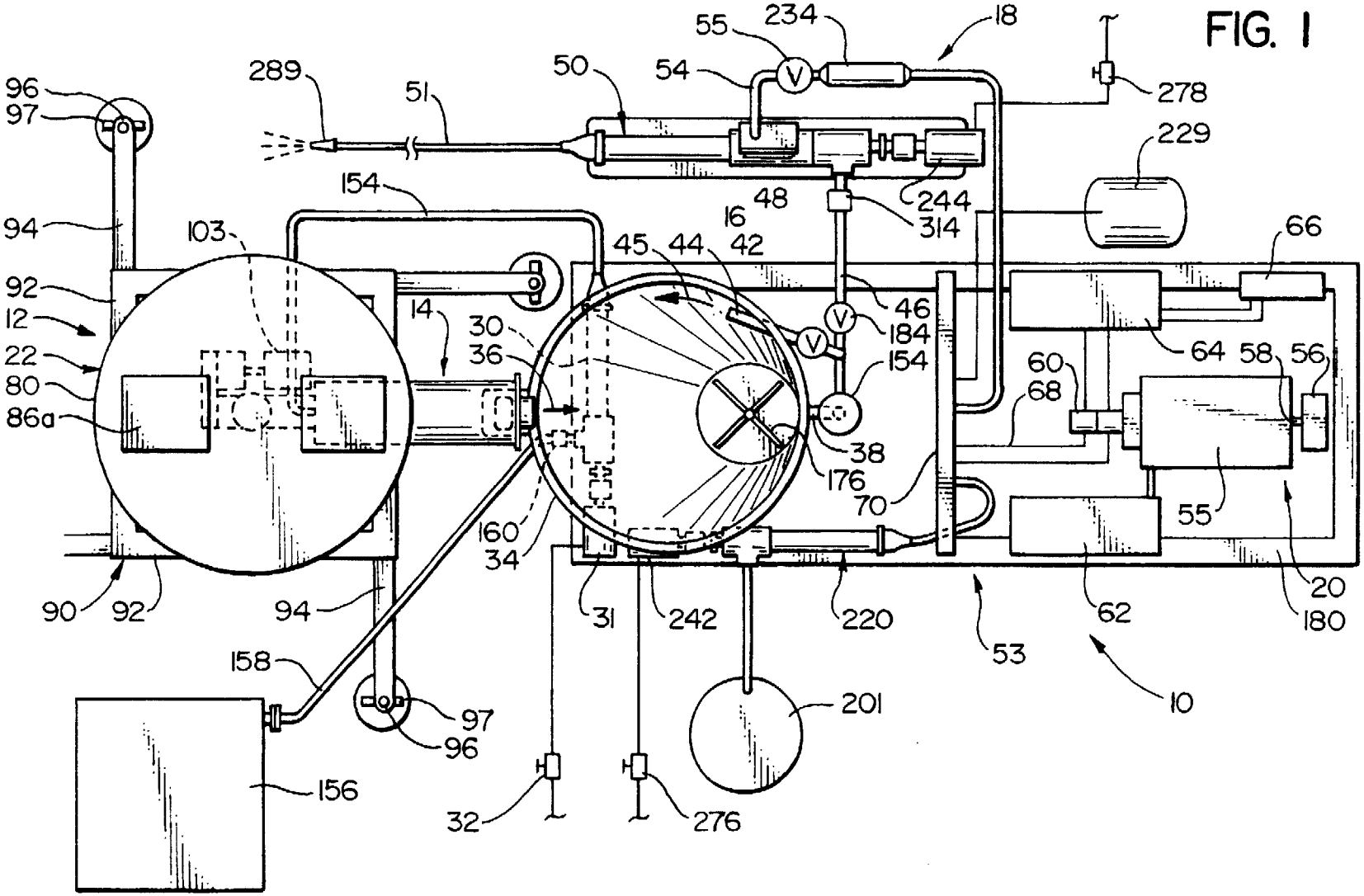
FIG. 1 is a plan view of a cement slurry-mixing and pumping apparatus in accordance with the present invention.
Figures 2A, 2B:
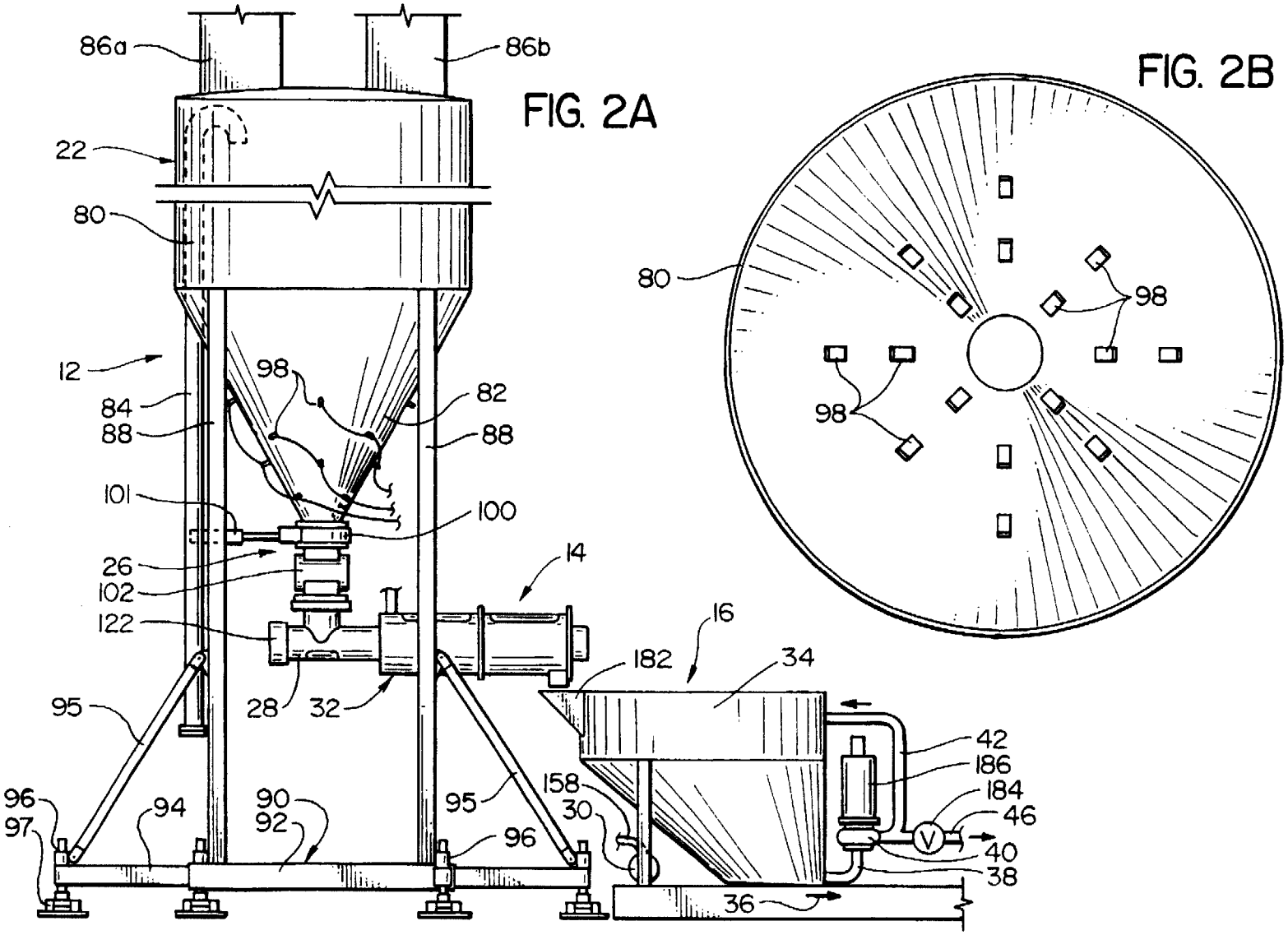
FIG. 2A is an elevational view of the apparatus of FIG. 1, particularly showing the cement supply, feed, and mixing components thereof in greater detail.
FIG. 2B is a plan view of the hopper assembly of the apparatus of FIGS. 1–2, showing the array of air pads which facilitate the metered feed of cement dust therefrom.

As can be seen in FIGS. 1 and 2, the cement slurry-mixing and pumping apparatus 10 of the present invention is comprised generally of five major assemblies, namely (1) a cement dust supply assembly 12, (2) a feed/premixer assembly 14, (3) a recirculating mixing tank assembly 16, (4) a pumping assembly 18, and (5) a power supply/control assembly 20.

The cement dust supply assembly 12 includes a hopper tower 22 for holding supply of cement dust. The cement dust is gravity fed through a metering assembly 26 at the base of the tower into the feed section 28 of the feed/premixing assembly 14.

Water is added at a metered rate from a pump 30, and the initial mixing of the cement slurry takes place in the feed/premix assembly 14. The slurry material is then discharged into the tub section 34 of the colloidal mixing assembly 16, in the direction indicated by arrow 36 in FIG. 1. The fluid slurry is drawn off from the bottom of the tub through line 38 to a high speed, high shear colloidal mixing pump 40, from which the material is discharged back into the top of the tub through line 42. As can be seen in FIG. 1, the discharge end 44 of line 42 extends through the wall of the tub, and discharges in a generally tangential direction, thereby imparting a strong circular flow to the slurry contained in the tub section, as indicated by the arrow 45 in FIG. 1.

A slurry feed line 46 is connected between the circulation pump and the discharge end of line 42, and a portion of the recirculating slurry is discharged under pressure through this to the pumping assembly 18, the primary component of which is a large capacity slurry metering pump 50. As can be seen in FIG. 1, feed line 46 is attached to the intake section 48 of the slurry metering pump, which discharges the slurry under pressure, through line 51.

The power supply/control assembly 20, in turn, provides power to operate the various pump drives and other motors throughout the apparatus, and controls the rates at which these various pieces of equipment operate. For purposes of clarity, only the major components of the power supply/control assembly have been shown in FIG. 1, and the individual hydraulic lines, electrical lines and so forth which are actually connected to the motors and other components do not appear therein.

The main power source for the assembly 20 is a diesel engine 55. An electric generator 56 is connected to one end of the diesel by a shaft 58, and a hydraulic pump 60 is driven from the other end of the engine. Cooling for the diesel is provided by a radiator/fan assembly 62. The hydraulic pump 60 draws hydraulic fluid from holding tank 64, this latter being provided with a cooling fan 66 for maintaining the temperature of the fluid within a proper operating range.

The output of hydraulic pump 60 is connected by pressure line 68 to hydraulic control panel 70. The hydraulic control panel includes controls (not shown in FIG. 1) for energizing/deenergizing and controlling the speed of the hydraulic motor-driven components of the apparatus.

The embodiment which is illustrated in FIGS. 1–2 is particularly configured to supply the slurry for production of a cellular cement grout. In this embodiment, the slurry is mixed with an aqueous finished foam material which is supplied from an optional foam generator assembly 53. The finished foam material is injected through line 54 to the intake side of the metering pump 50, at a point downstream of the slurry intake. A check valve 55 is mounted in line 54 downstream of the foam conditioner to prevent the grout from backing up through line 54 when the foam supply is secured. The foam and cement slurry are mixed within the body of the pump, and within the first section of the discharge hose 51 to form the foamed cement grout material.

Preferably, the water and slurry metering pumps 30 and 50 are of the positive displacement, progressive cavity, rotor-stator type, suitable models of which are available under the Moyno™ trademark from Robbins & Meyers, Inc., Dayton, Ohio. This type of pump has the great advantage in the present invention of delivering a rate of flow which is directly proportional to its rate of operation; in other words, an increase in the drive speed of the pump will produce a directly proportional increase in the rate of output. This provides the present invention with the ability to precisely control and adjust the proportional rates at which the various components are mixed to form the final product. Although pumps of Moyno™-type are preferred for use in the present invention, owing to their high degree of accuracy and reliability, roller pumps, gear pumps and a number of other suitable pumps having variable speed drives may be suitable for use in some embodiments of the present invention.

Thus, by use of the metering pumps, variable speed drive motors, and associated speed control and monitoring systems, the present invention enables the operator to control and selectively adjust the proportions of each of the constituents of the grout—cement dust, water, slurry, foam concentrate, foam solution, finished foam—at will during operation of the machine, whether monitoring or increasing/decreasing the output of the apparatus.

Having provided an overview of the apparatus of the present invention, specific aspects of the interconnected assemblies which make up the system, and their manner of operation, will be discussed in greater detail in the following sections.

b. Cement Dust Feed Assembly

As was noted above, the principal component of the water/cement supply assembly is the hopper tower 22. As is shown in FIG. 2, this comprises a tall, cylindrical hopper section 80 having a downwardly tapering, frustoconical lower end 82 which directs the cement dust into the metering subassembly. The hopper section stores a large quantity of cement dust, and this is replenished from time to time via fill pipe 84, through which the cement dust is blown by air pressure from delivery trucks or similar conveyances. Twin bag houses **86*a*, 86*b*** are installed on the top of the tower to prevent escape of dust during filling and operation of the assembly.

The hopper section is supported by a series of column members 88 (preferably four in number) above a base platform 90. The base platform is formed of four, square cross-section tubular members 92 welded together to form the perimeter of a square, with the open ends of the members facing outwardly from the corners thereof. Each of the tubular members 92 houses a telescoping leg unit 94 which can be extended for deployment and erection of the tower, and retracted for storage and transportation. In the deployed configuration, pivoting angle braces 95 are pinned between the leg units and the column members 88 to provide additional stability. Screw-adjustable pad assemblies 96 are mounted at the ends of the leg members to permit accurate leveling/vertical alignment of the assembly at the site.

In each of the pad assemblies 96, a beam-type scale unit 97 is mounted between the vertical adjustment screws and the horizontal foot plates. The scale units provide a visual readout of the weight carried by each of the leg units 94. This feature provides the invention with several important advantages. Firstly, the units help insure even weight distribution and thereby increase the stability during erection of the tower assembly. Also, as will be described in greater detail below, it is important that the cement dust feed be precisely metered; by monitoring the weight of the tower using the scale units and periodically "topping off" the hopper, the operator is able to maintain the level of cement dust in the hopper within a relatively constant range, so as to maintain a substantially constant weight or pressure of the material against the intake side of the metering assembly 26. Furthermore, by monitoring the changes in the weight of the hopper during operation, the operator is able to gauge the rate at which the cement dust is being fed through the metering assembly, and whether this rate matches the specifications for the particular slurry material which is being produced.

A significant advantage which is provided by the tall tower hopper assembly with the extendable leg members is that the large, square footprint of the assembly provides very stable support in a wide variety of job sites, yet when the leg members are retracted and the tower is tipped on its side, it assumes a long, horizontal form with a compact cross-section, which is ideal for transportation by means of a single semi-truck trailer. Similarly, as will be described in greater detail below, the tub, pumping, and power supply assemblies are mounted on a single frame which is configured to be carried on another semi-truck trailer. Accordingly, the entire apparatus can be transported to the site on two trailers, and then quickly unloaded and erected with the assistance of a crane.

To further insure even, consistent feeding of the cement dust to the metering assembly intake, an array of air injection pads 98 are installed in the frustoconical lower end of the hopper. Such air pads are commonly used in the food products industry (e.g., for grain handling) and certain other industries, to insure complete emptying of the hopper. However, in combination with the metering assembly (which is not normally found on grain handling equipment and similar systems) the pads 98 in the present invention serve the additional function of fluidizing and conditioning the very fine cement dust at the base of the tower, so as to maintain a constant dust density as this is fed into the metering assembly.

As can be seen in FIG. 2, the metering assembly 24 includes a large diameter gate valve 100 which opens and closes the bottom end of the frustoconical section 82 of the hopper; operation of the gate valve is preferably controlled remotely by means of a hydraulic ram mechanism 101, although in some embodiments a conventional hand wheel mechanism may be fitted. Below this is positioned a rotary air lock 102, driven by a variable-speed electric motor 103 which controls the rate at which the cement dust is dispensed from the hopper. The rate at which the cement dust is fed is directly proportional to the speed of the rotary air lock; increasing the speed of the valve proportionally increases the flow of cement dust, and a decrease in speed produces a corresponding, proportional decrease in the flow.

c. Premixing Assembly

The bottom of the metering valve 102 is flange-mounted to the upper side of the feed section 28 of the feed/premix assembly 14. As can be seen more clearly in FIG. 5, the cement dust is gravity fed into the throat 110 of the screw feed section, in the direction indicated by arrow 112. The housing 114 of the feed section encloses an feed screw 116 which is mounted to a drive shaft 118; the end of the drive shaft extends through a bearing 120 at the end of the housing and is driven by an electric motor 122 or other drive motor (see FIG. 2A).

Figure 7:
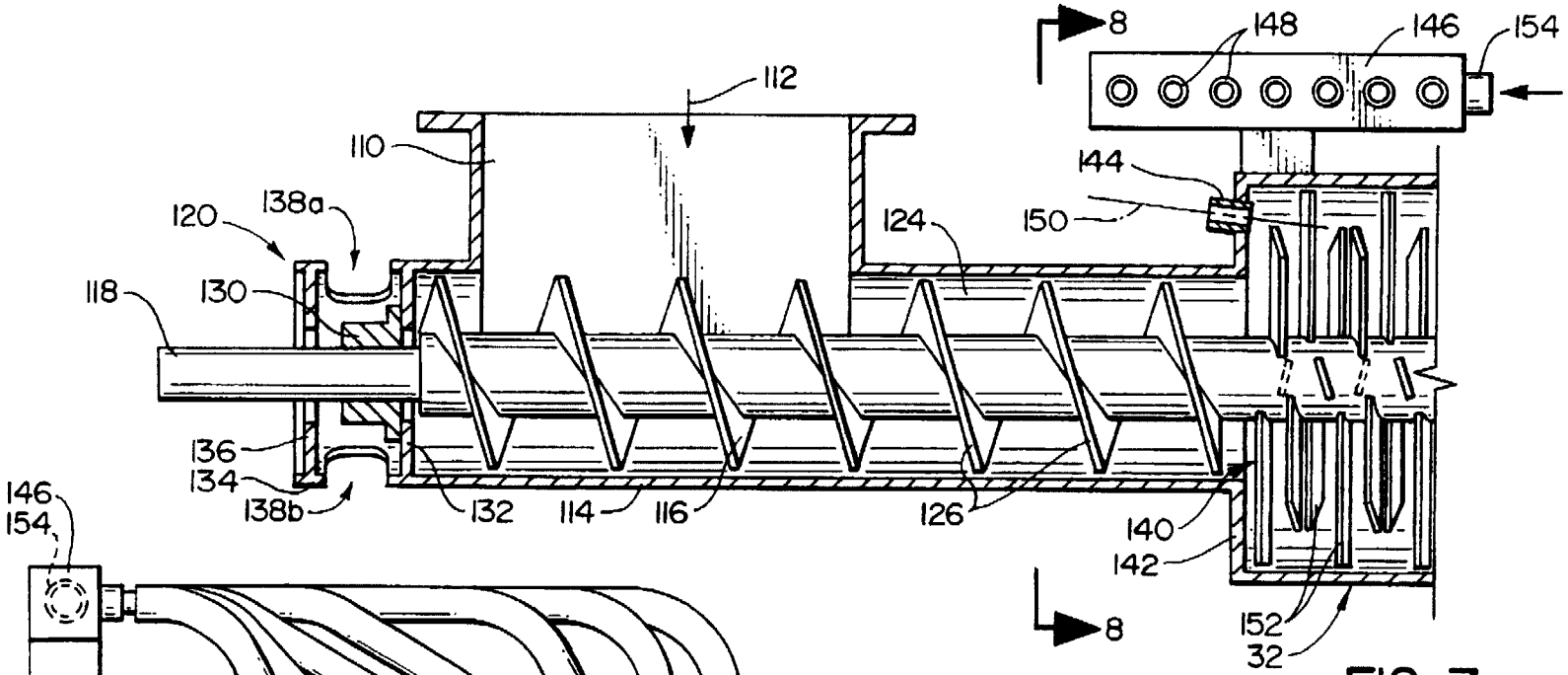
FIG. 7 is a side, cross-sectional view showing the intake throat and feed screw section of the premixing assembly of FIG. 5.

As can be better seen in FIG. 7, an elongate, cylindrical feed tube 124 separates the dust-receiving throat 110 from the receiving end of the premixing section 32. Preferably, as is shown, the feed tube closely surrounds the feed screw 116, and is sufficiently long that it contains at least three flight portions 126 of the feed screw; there may be additional flight portions in the separation tube, depending on the embodiment, but there are preferably at least three. This configuration provides the advantage of smoothing or "leveling out" the stream of cement dust so that this is fed at a very consistent rate into the premixing chamber; also, the separation provided by the feed tube and flight portions of said screw—therefor flights prevents water/moisture from backing up to the intake throat 110 and causing a dampening of the dust which might result in a buildup of the material or blockage.

With further reference to FIG. 7, particular note will be made of the bearing assembly 120. As can be seen, the collar bearing 130 itself is mounted to the end cap 132 of the feed/premix assembly, so that the drive shaft 118 extends outwardly from this. The bearing is surrounded by a generally cylindrical housing 134, which may be formed as an extension of the chamber, with an annular plate 136 mounted in its outer end. The housing 134 serves to protection the bearing from impact damage during operation or transportation of the apparatus. Upper and lower openings 138*a*, 138*b* are formed in the wall of housing 134; these openings permit any material which may have escaped through the end of the assembly to be cleared away by flushing or knocking this out through the bottom opening, and also permits access to the bearing for lubrication and other maintenance.

Figure 5:
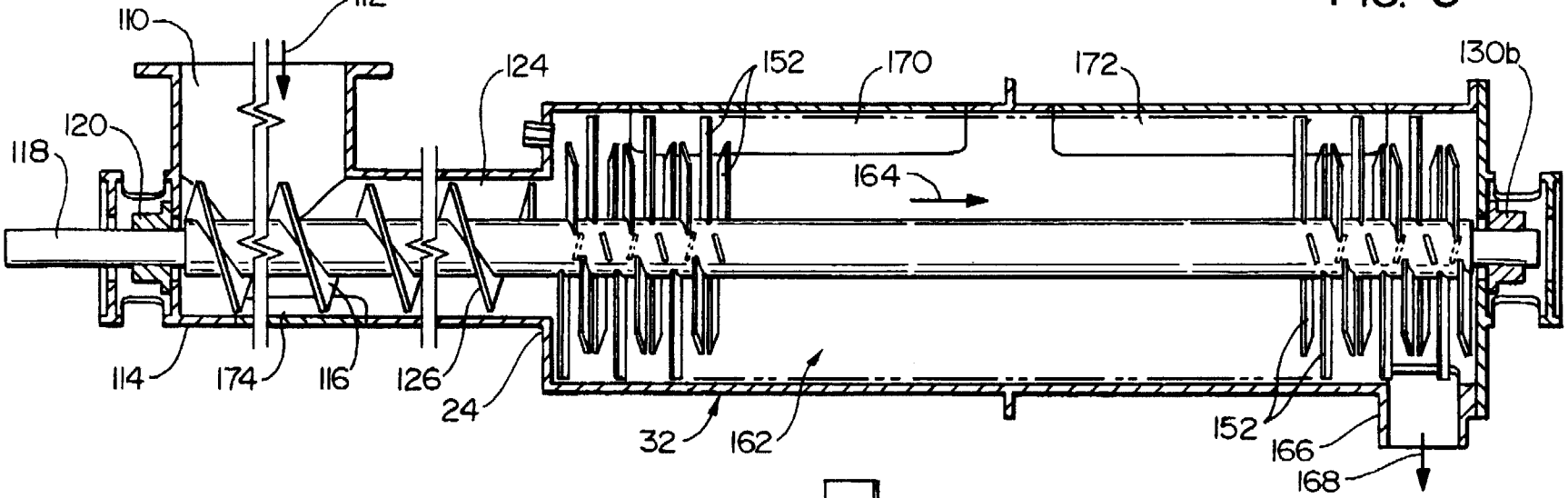
FIG. 5 is a side, cross-sectional view of the horizontal feed and premixing assembly of the apparatus which is shown in FIGS. 1–2.
Figure 6:
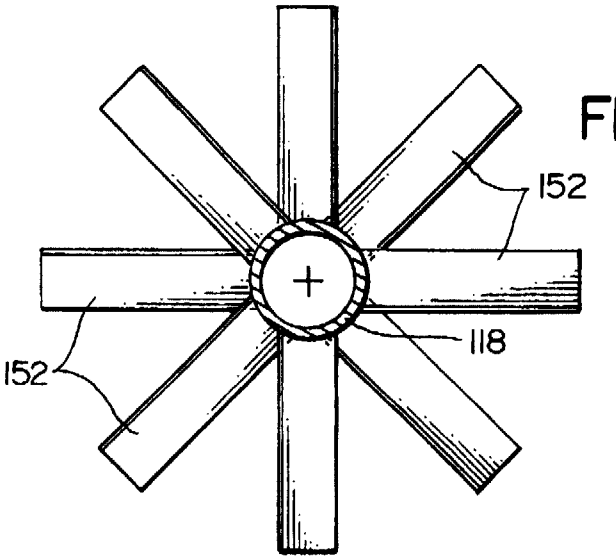
FIG. 6 is an end view, looking from the right hand end in FIG. 5, of the shaft member of the premixing assembly shown in FIG. 5.

Rotation of the feed screw 116 carries the cement dust longitudinally through housing feed tube, and discharges this into the receiving end 24 of the premixing section 32. As was noted above, the feed tube 124 is preferably long enough that at least three flight portions 126 of the feed screw separate the inlet throat 110 from the receiving end of the premixing section; as is shown in FIG. 5, there are preferably also a minimum of three flight portions 126 in the intake throat 110, with the result that the feed screw is preferably provided with the minimum of six flight portions in all. As was previously noted, this prevents the material from bunching up and also gives a more uniform, non-varying feed supply, which in turn yields a very high degree of accuracy in the blending of the cement and water.

Figure 8:
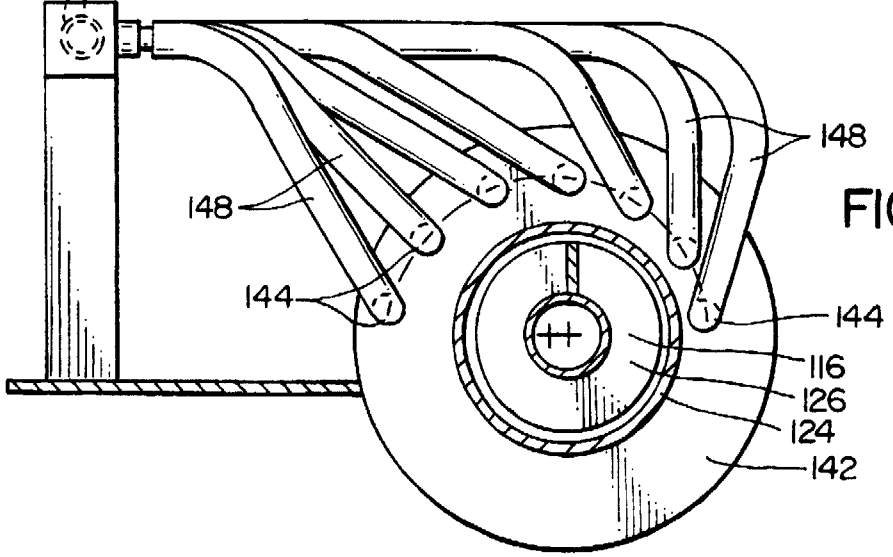
FIG. 8 is an end view of the premixing assembly of FIGS. 5–7, showing the arrangement of water jets at the intake end of the assembly.

The cement dust is discharged into the premixing section 32 through an opening 140 in the end plate 142. The water is also injected in this area, for mixing with the cement dust to form the cement slurry. As is shown in FIGS. 7–8, the water injection jets 144 are preferably configured to evenly distribute the water into the chamber and flush the cement dust away from the intake opening 140. As can best be seen in FIG. 8, several of the jets 144 (seven jets in the embodiment which is illustrated, although this number may vary depending on the actual configuration of the premixing assembly) are positioned at annularly spaced locations around the axis of the mixer shaft 116. Water is supplied to the jets from a manifold 146, through water lines 148. Each of the jets 144, which are mounted in the end plate 142, is configured to inject the water under pressure along an axis 150 which is directed generally axially towards the discharge end of the premixer assembly, and angled somewhat inwardly (e.g., about 5°) toward the central axis of the chamber. The force of the incoming water serves to drive or "flush" the incoming cement dust into the mixing chamber and away from the inward opening 140, ensuring both consistent flow and preventing any buildup of material around the inlet opening. Also, as can be seen in FIG. 8, the water jets 144 are positioned step-wise at increasing radial distances from the axis of the assembly, and all of these are positioned in the upper part of the chamber. This arrangement ensures complete cleaning of the mixing blades 152 at the inlet end of the premixing chamber, being that essentially the full length of the blade—from base to tip—is washed by the jets during each rotation of the shaft. Also, there is essentially a complete "fan" of water across the upper part of the chamber, which flushes the cement dust/slurry down into the water/slurry at the bottom of the chamber so as to ensure complete mixing and a steady flow of the material toward the outlet end of the chamber.

The water is supplied under pressure to manifold 146 from water metering pump 30, via water pressure line 154. The water metering pump is provided with a variable speed drive motor and tachometer output to control its speed of operation. The precise metering of the water supply which is provided by pump 30 is critical to the accurate blending of cement and water at the correct proportions. To further enhance accuracy, the metering pump preferably draws the water under a very low head pressure from a storage tank 156, via line 158, instead of from a high pressure source such as a municipal water main. Furthermore, to monitor the water flow rate, in comparison with the flow rates of the other materials, a flow meter 160 is installed on the metering pump, preferably on the intake line as shown in FIG. 1.

Figure 3:
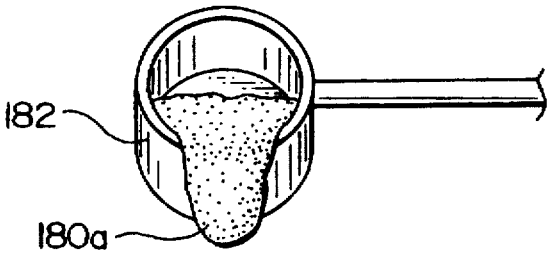
FIG. 3 is an elevational view of a cement slurry prior to colloidal mixing using the assembly of the present invention, showing this being poured from a ladle so as to illustrate the comparatively viscous consistency thereof.
Figure 4:
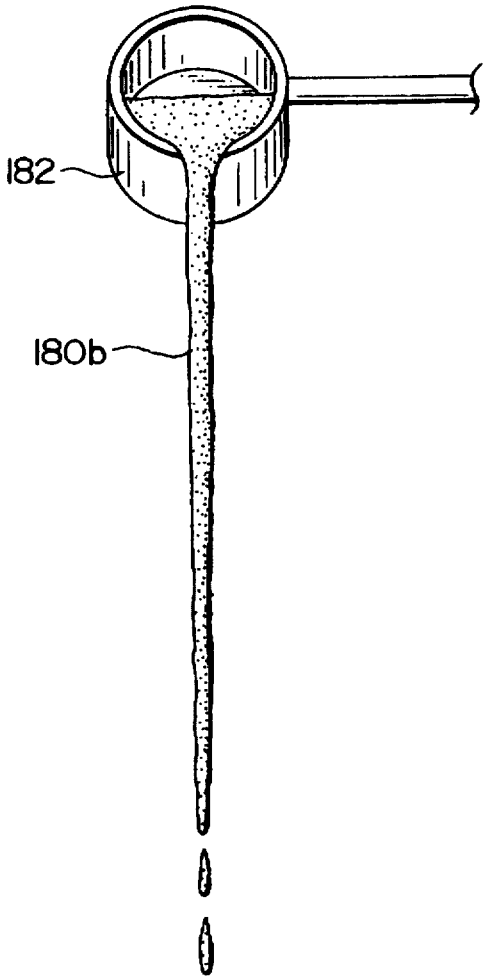
FIG. 4 is an elevational view showing the same cement slurry as in FIG. 3, but following colloidal mixing using the colloidal mixing/tub assembly of the present invention, showing this being poured from the same ladle so as to illustrate the comparatively fluid consistency thereof.

The drive shaft 118 extends longitudinally through the mixing chamber 162, and in this section the shaft is fitted with a multiplicity of the angled mixing blades 152 (see also FIG. 4). Although for purposes of clarity the blades 152 are shown only at the ends of the shaft in FIG. 3, it will be understood that in most embodiments the blades will be mounted along the shaft over the full length of the mixing chamber 162. The outer end of the shaft 118 is supported in a second bearing 130*b*.

In operation, the mixing chamber 140 is partially filled with the fluid slurry. The rotation of the blades 152 within the chamber provides a thorough initial mixing of the cement with the water, and also the angled aspect of the blades forces the flow of the material longitudinally through the chamber, in the direction indicated by arrow 164. A downwardly directed drain port 166 is provided at the outlet end of the chamber, through which the slurry is discharged into the mixing tub, in the direction indicated by arrow 168.

As can also be seen in FIG. 5, the upper portion of the mixing chamber 124 is fitted with access hatches 170, 172 which may be removed for inspection and cleaning of the chamber and blades. Similarly, the bottom portion of the intake throat area of the feed section is provided with an access hatch 174 for cleaning and inspection.

d. Colloidal Mixing Assembly

As was noted above, and as can be seen in FIGS. 1 and 2, the colloidal mixing assembly, pumping assembly, and power supply assembly are all mounted on a single rectangular frame 180 which permits this equipment to be transported by truck and trailer as a single unit.

The tub section 34 of the colloidal mixing assembly has an intake chute 182 for receiving the slurry which is discharged from the feed/premixing assembly 14. Within the tub itself, a constant circulatory motion is maintained by the tangentially directed discharge from the recirculation line 42. Furthermore, a vertical paddle mixer 176 driven by a hydraulic or electric motor (not shown) is mounted to prevent any settling of the material in the bottom part of the tub.

The colloidal mixing pump intake line 38 draws from the bottom of the tub 34, in the direction indicated by the arrow in FIG. 2. As was also noted above, the colloidal mixing pump 40 is a high speed, high shear-type pump; suitable examples of this type of pump are available from Hayward Gordon, Buffalo, N.Y., such as their Series A Centrifugal Process Pumps. The high speed shearing action of the colloidal mixing pump serves to break down the cement particles in the slurry, producing smaller and smaller cement particles which became fully surrounded by water molecules to form a highly fluid colloidal cement matrix. This yields an extreme change in the consistency of the cement slurry material, even though the water-to-cement ratio remains constant.

FIGS. 3 and 4 provide a pictorial comparison of the consistency of the slurry material, before and after circulation through the colloidal mixing pump and tub. The figure on the left (FIG. 3) shows a slurry 180*a* in its condition prior to being circulated through the colloidal mixing pump, being poured from a ladle 182; as can be seen, the material in this condition exhibits a comparatively high viscosity and poor flowability qualities. The figure on the right (FIG. 4) shows the same material 180*b* being poured from the same ladle 182, but after this has been circulated through the colloidal mixing pump 40 and tub 34. As can be seen, the material exhibits greatly enhanced fluidity after circulation through the colloidal mixing pump.

In short, prior to colloidal mixing, the material is comparatively "thick" in consistency, while following colloidal mixing, the same material becomes comparatively "runny". The comparatively "runny" condition which the colloidal mixing produces is of great importance when the slurry output is used for mixing with finished foam material, because this yields a more stable, resilient bubble structure in the foamed cement grout. This is apparently due to the ability of the very finely divided, uniformly hydrated cement particles to evenly surround and "coat" the individual microbubbles of the foam material when the latter is mixed into the slurry.

With further reference to FIG. 2, and also FIG. 1, it will be noted that the intake line 46 for the slurry metering pump branches off from the recirculation line 42, close to the discharge side of the colloidal mixing pump 40. The importance of this configuration is that this ensures that the cement slurry will be delivered to the intake section of the slurry metering pump under a steady head of pressure; this head pressure greatly enhances the accuracy of the slurry metering pump, in proportionally mixing the cement slurry with the finished foam. Also, the cutout valve 184 is mounted in feed line 46 to open and close the supply of slurry to the metering pump. When the valve 184 is closed, the slurry simply recirculates through the colloidal mixing pump and tub, until the desired consistency has been achieved (see FIG. 4); the valve is then opened to supply the material to the metering pump on a continuous basis.

In addition to colloidal mixing, the tub 34 also provides a large capacity reservoir which serves to finally "smooth out" any inconsistencies in the material which is discharged from the premix assembly.

The colloidal mixing pump 40 is driven by an electric motor 186 in the embodiment which is illustrated. However, a suitable hydraulic motor or other drive may be utilized in some embodiments.

e. Pumping Assembly

As was noted above, the primary component of the cement pumping assembly 18 is the large-capacity progressive cavity rotor-stator type pump 50. Because the output rate of this pump is directly proportional to its operating speed, it is possible to use the drive motor controls to precisely adjust the grout flow rate relative to the foam supply rate, thus enabling the operator to precisely adjust the density and other qualities of the foamed cement grout. For example, the speed of the slurry metering pump may be increased or decreased while maintaining the foam input constant, so as to increase or decrease the ratio of foam to cement slurry and thereby change the density of the finished product. If it is desired to keep the grout output rate constant, then the slurry metering pump 50 may be maintained at a constant speed, while the supply of finished foam material is increased/decreased as necessary.

When used to prepare foamed cement grouts, the initial mixing of the finished foam material and cement slurry takes place within the body of the pump 50, by the action of its internal screw mechanism. This is followed by additional mixing between the two components in the first part of the discharge line 51, over a distance of perhaps 100 feet or so. The material is thus fully combined to form a very consistent quality, homogenous foamed cement grout which is discharged through the nozzle 39 (as shown in FIG. 1) or other injection apparatus. This material (which the present invention supplies at a rate many times that of which prior art systems are capable), may be used for any desired purpose; in particular, as was noted above, the material may be used for filling a large void, such as underground cavities, or otherwise for filling and/or stabilization of geological formations.

Figure 11:
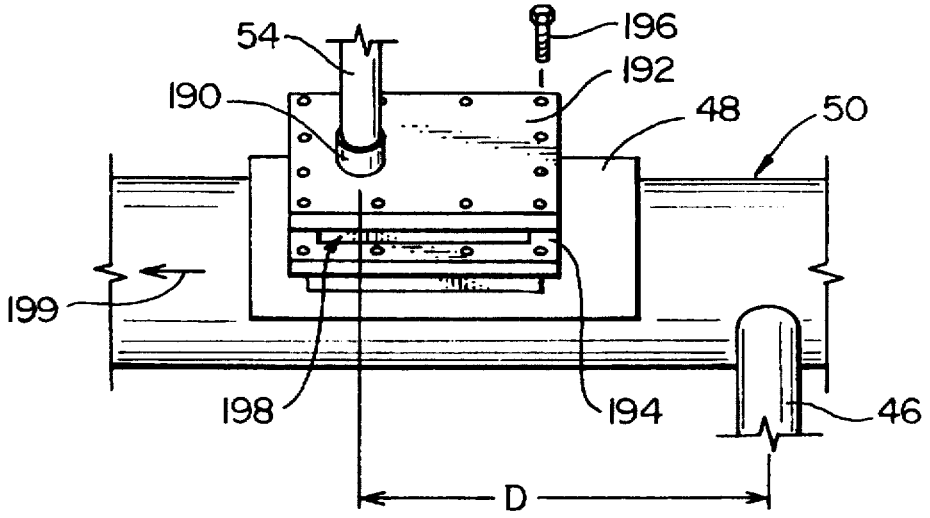
FIG. 11 is an enlarged elevational view of the intake section of the slurry metering pump of the apparatus of FIGS. 1–2, showing the foam and slurry intake ports and a removable cover which permits access to the interior of the pump for maintenance.

An important aspect of the particular rotor-stator type pump 50 which is employed in the embodiment of the present invention which is illustrated herein is the configuration of its foam intake section. Firstly, as can be seen in FIG. 11, the finished foam supply line 54 is connected to the intake section 48 of the pump 50 at a through fitting 190 which is located more or less centrally in a detachable cover plate 192. The cover plate mates to a rectangular flange 194 which is permanently mounted to the intake section of the pump, and the plate is detachably secured to the flange by means of bolts 196 which extend through cooperating bores in the two members. When the cover plate is mounted to the flange, this forms a fluid-type fit, and the finished foam material is pumped through line 54 into a large rectangular intake throat 198. However, the cover plate can easily be removed so that personnel can access the screw-mechanism (not shown) of the pump, for inspection and to remove the buildup of material which tends to develop where the finished foam comes into initial contact with the cement slurry.

With further reference to FIG. 11, it will also be noted that the foam intake port is positioned a spaced distance "D" downstream of the slurry intake 146, in the direction indicated by arrow 199. This distance "D" is selected to be a distance which is sufficient to prevent the lighter finished foam material from "bubbling" back up through the slurry intake line or otherwise interfering with the slurry feed; a distance of approximately 1½–3 feet is suitable for use in the illustrated embodiment of the apparatus.

f. Power Supply/Control Assembly

As was noted above, the prime mover for the embodiment which is illustrated in FIG. 1 is a diesel engine, which drives an electric generator 56 and a hydraulic pump 60. The output from the hydraulic pump is directed to the various hydraulic motors throughout the system by the hydraulic control panel 70, and similarly, the power output from the electric generator is supplied to an electrical distribution panel 56 for use with those components which are electrically powered. It will be understood, however, that the apparatus may, in some embodiments, be essentially a "pure" electric or hydraulic system (as opposed to the "hybrid" power system which is employed in the illustrated embodiment), in which all of the motors are operated by one or the other, and that other sources of power may be employed in some systems.

g. Foam Generator Assembly

As was noted above, the foam generator assembly is optional, in that this is used only in those embodiments of the present invention in which the slurry output is used for the continuous preparation of cellular cement grouts. However, to provide a full understanding of the present invention, a description of the principal components of the foam generation assembly and their operation will be provided in the following paragraphs.

Figure 9:
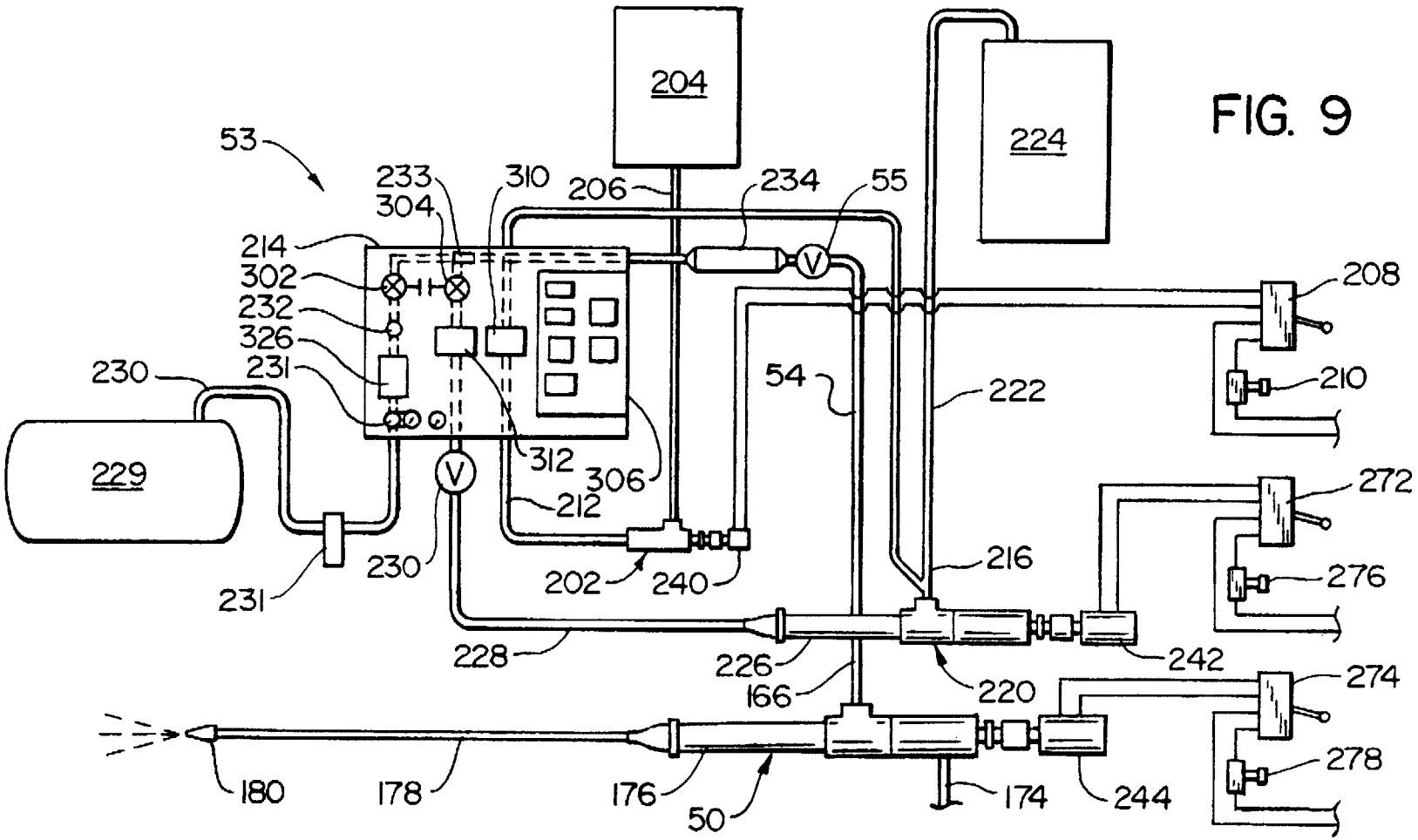
FIG. 9 is a schematic view of the control, mixing, and proportioning components of the foam generation section of the apparatus of the present invention.

The foam solution for forming the finished foam may be provided from a tank 201 in a premixed form as is shown in FIG. 1, or, as is shown in FIG. 9, an additional metering pump 202 and control circuit may be included to mix foam concentrate with water to form the solution on a continuous basis. Thus, in the embodiment which is shown in FIG. 9, the concentrate metering pump 202 draws the foam concentrate from a drum or tank 204, via concentrate line 206; suitable foam concentrate materials include "Mearl Geocell Foam Liquid" foam concentrate, available from the Mearl Corporation, Roselle Park, N.J., and similar products available from Elastizell Corporation of Ann Arbor, Mich.

The pump 202 is provided with its own on/off valve 208 and speed adjustment valve 210, which control the drive motor 211. The concentrate output line 212 is routed through a flow meter 262 in control assembly 214, and from this to a wye fitting 216 on the intake side of a solution metering pump 220, with a water line 222 from tank 224 being connected to the other side of the wye fitting. Preferably, the water is provided to the intake side of the metering pump under only a slight, gravity head of pressure, so that the flow from foam concentrate line 212 is unimpaired. Thus, the speed of the solution metering pump 220 can be set at a predetermined rate, and then the speed of the concentrate metering pump 202 can be adjusted to provide the correct flow rate of foam concentrate to produce a solution having the desired proportions. For example, in terms of relative operating rates, the solution pump may be set at 10 gpm and the concentrate pump may be set at 0.4 gpm in order to produce a 4% concentrate solution.

The foam solution is discharged from metering pump 220 through line 228, and is combined with air provided at a constant pressure from reservoir 229, via line 230; an oil separator 231 is provided to eliminate any oil from the compressed air which might cause deterioration of the bubble structure of the foam material. The air is provided at an infinitely adjustable, metered rate, selected relative to the adjustable flow rate of the foam solution, using the air pressure regulator 231 and air metering valve 232. The air and foam solution lines meet at a venturi mixing unit 233, in which the flow of compressed air creates a vacuum effect which picks up the foam solution entering from the bottom of the venturi. The combined solution/air mixture exits the discharge side of the unit and then passes through foam conditioner 234.

The conditioner 234 may be of any suitable type, such as a tubular chamber filled with a medium for conditioning the bubble structure of the foam material flowing therethrough. From here the finished foam material is fed to the intake of the slurry pump 50; the check valve 55 downstream of the foam conditioner prevents grout from backing up from the pump through line 54.

h. Mixing Controls

FIG. 8 shows a schematic view of the control/monitoring layout of the foam and grout mixing systems.

As can be seen, the relative speeds of the hydraulic motors 240, 242, 244, which operation the concentrate, foam solutions, and slurry metering pumps 202, 220, 50, can be precisely controlled by the operator from panel 270 (see FIG. 10); i.e., the speed of each pump can be increased or decreased as necessary to adjust the density, dilution ratio, or other characteristic of the product with which that pump's constituent is associated. Each pump circuit is provided with, in series, an on/off cutout valve 208, 272, 274; a speed adjustment valve 210, 276, 278; and a hydraulic pressure gauge 280, 282, 284. This arrangement enables the operator to energize/deenergize the machine using the cutout valves without having to disturb the speed adjustment valves once these have been set. The pressure gauges, in turn, provide a back-up check to make sure that the hydraulic pressure is within the operating range of the motors and other equipment.

In order to monitor the pump speeds as these are adjusted, the variable speed hydraulic motors 240, 242 and 244 of the concentrate pump 202, solution pump 220, and grout pump 50 are provided with shaft-mounted tachometer drives 290, 292, 294 having associated electronic pickup units 296, 298, 299. The corresponding tachometer readouts 300, 302, 304 in display panel 306 thus permit the operator to closely monitor the actual speeds of the pumps, and to increase or decrease their speeds to accuracies within a fraction of revolution per minute. As was noted above, the flow of the compressed air is controlled by means of the metering valve 232.

Finally, the actual flow rates at which the constituents are being delivered are verified by means of the series of flow meter sending units 310, 312, 314 and their readouts 320, 322, 324 in the display panel. A fourth flow meter 326 and readout 328 are associated with the compressed air supply line 230. By monitoring and comparing the digital flow meter readouts provided in the display panel, the operator is able to determine that the proper proportional relationships are being maintained between the flows of the various constituents. An exemplary flow meter which is eminently suitable for use in the system described above is the FLUMAG™ Electromagnetic Flow Meter, available from Schlumberger Industries, Inc., Measurement Division, Greenwood, S.C.

Figure 10:
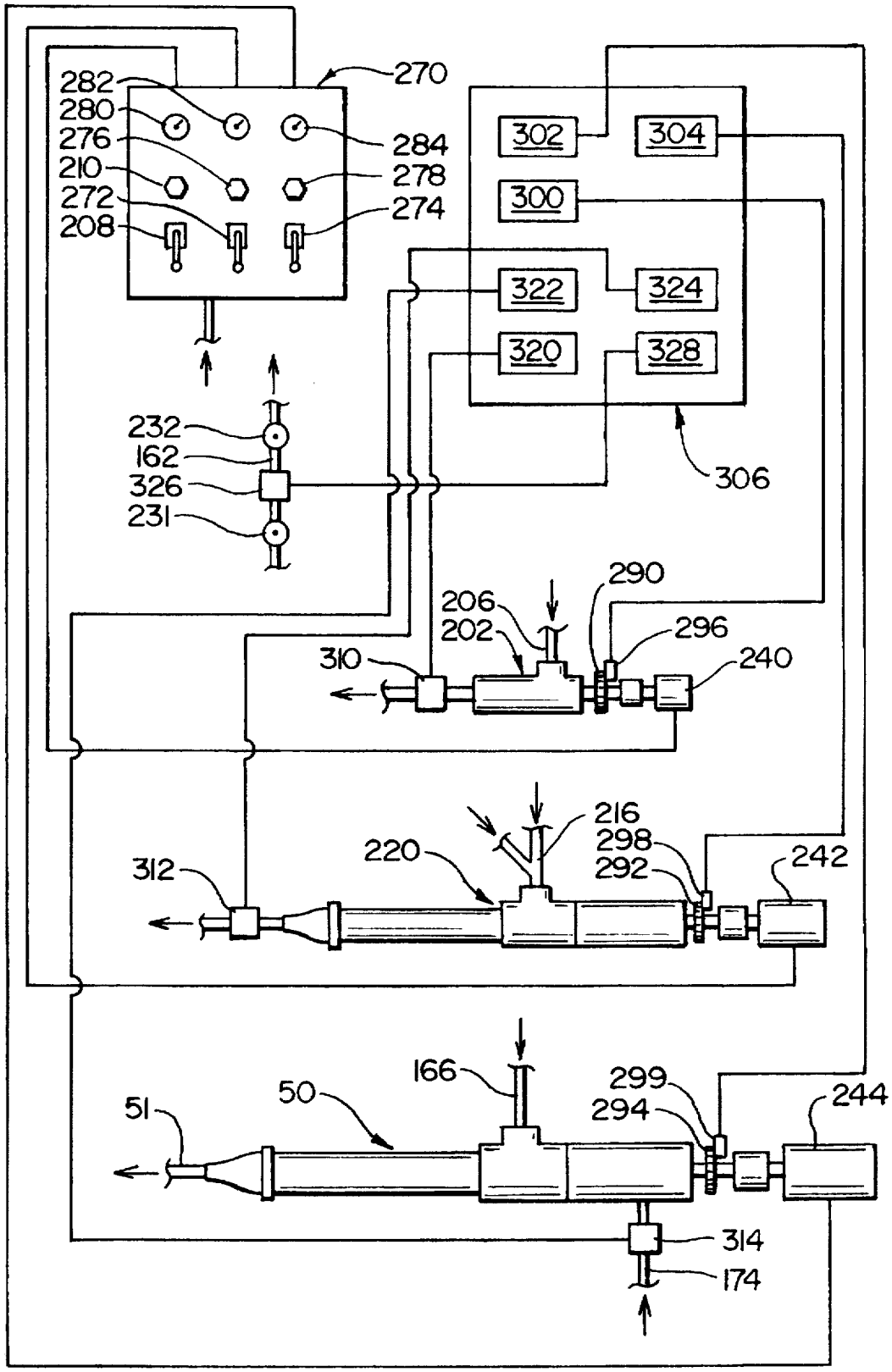
FIG. 10 is a diagrammatical view of the control and monitoring systems of the foam generating section of FIG. 9.

Although not shown in FIGS. 9–10, water metering pump 30 is controlled in substantially the same manner as the other metering pumps, and its output rate is monitored by means of flow meter 160 (see FIG. 1).

It is to be recognized that various alterations, modifications, and/or additions may be introduced into the constructions and arrangements of parts described above without departing from the spirit or ambit of the present invention as defined by the appended claims.

What is claimed is:

1. An apparatus for high-capacity production of high-fluidity cement slurry which is substantially free of aggregate material, said apparatus comprising:

means for providing a supply of hydraulic cement dust at an adjustable, metered rate;

means for providing a supply of water at an adjustable, metered rate;

means for mixing said metered supply of cement dust with said metered supply of water to produce an initial cement slurry having a water-to-cement ratio which is precisely adjustable by adjusting said metered rates at which said water and cement dust are provided thereto; and means for colloidally mixing said initial cement slurry which is produced by said mixing means so as to produce a high-fluidity colloidally-mixed hydraulic cement slurry which is substantially free of aggregate material.

2. The apparatus of claim 1, wherein said means for providing water at an adjustable, metered rate comprises:

a positive displacement pump for delivering said water, said pump having an output rate which is directly proportional to an operating speed; and control means for selectively adjusting said operating speed of said pump so as to adjustably control said metered rate at which said water is delivered.

3. The apparatus of claim 2, wherein said positive displacement pump for delivering said supply of water comprises:

a progressive-cavity, rotor-stator type pump driven by a variable speed motor.

4. The apparatus of claim 3, wherein said variable speed motor is a variable speed hydraulic drive motor.

5. The apparatus of claim 2, wherein said means for providing a supply of cement dust at an adjustable metered rate comprises:

a hopper assembly for holding a bulk amount of said cement dust; and a metering valve assembly mounted to said hopper assembly for dispensing said cement dusty therefrom at said adjustable metered rate.

6. The apparatus of claim 5, wherein said metering valve assembly comprises:

a rotary metering valve for dispensing said cement dust, said metering valve having an output rate which is directly proportional to an operating speed thereof; and control means for selectively adjusting said operating speed of said rotary metering valve.

7. The apparatus of claim 6, wherein said rotary metering valve is a rotary air lock drive by a variably speed motor.

8. The apparatus of claim 7, wherein said means for colloidally mixing said initial cement slurry which is produced by said primary mixing means comprises:

a tub section into which said initial cement slurry is discharged from said mixing means; and a high-speed, high-shear mixing pump having an intake line for drawing said slurry from said tub section and a discharge line for returning said slurry to said tub section so that said colloidal mixing pump recirculates said slurry through said tub section until said high-fluidity colloidally-mixed hydraulic cement slurry is formed.

9. The apparatus of claim 8, further comprising:

means for pumping said high-fluidity colloidally mixed cement slurry from said colloidal mixing means at an adjustable, metered rate.

10. The apparatus of claim 9, wherein said means for pumping said colloidally mixed cement slurry at an adjustable, metered rate comprises:

a positive displacement pump for delivering said colloidally-mixed slurry, said pump for delivering said colloidally-mixed slurry having an output rate which is directly proportional to an operating speed thereof; and control means for selectively adjusting said operating speed of said pump for delivering said colloidally-mixed slurry so as to adjustably control said metered rate at which said slurry is delivered thereby.

11. The apparatus of claim 10, wherein said positive displacement pump for delivering said colloidally-mixed slurry comprises:

a progressive-cavity, screw-type pump driven by a variable speed motor.

12. The apparatus of claim 11, wherein said means for pumping said colloidally-mixed cement slurry further comprises:

a conduit for supplying said colloidally mixed slurry to said pump for delivering said colloidally-mixed slurry, said conduit being connected to said discharge line proximate a discharge side of said high-speed, high-shear colloidal mixing pump so that said colloidally-mixed slurry is supplied to an intake port of said for delivering said slurry pump under a substantially constant head of pressure.

13. The apparatus of claim 11, further comprising:

means for providing a supply of finished foam to an intake side of said pump for delivering said slurry at an adjustable, metered rate, so that said colloidally-mixed slurry and said finished foam are mixed therein so as to form a foamed cement grout having a foam-to-slurry ratio which is precisely adjustable by adjusting said rate at which colloidally-mixed slurry is supplied by said pump for delivering said colloidally-mixed slurry and said finished foam is provided by said foam supply means.

14. The apparatus of claim 6, wherein said means for mixing said metered supply of cement dust with said metered supply of water comprises:

a generally horizontally-extending mixing assembly, said mixing assembly comprising:

a cement dust feed section for receiving said supply of cement dust which is dispensed from said hopper assembly; and a mixing section for receiving said supply of cement dust from said feed section and said supply of water, and for combining said cement dusty with said water to form said initial cement slurry.

15. The apparatus of claim 14, wherein said feed section of mixing assembly comprises:

a vertically-extending throat portion for receiving said supply of cement dust which is fed from said hopper assembly by said metering valve.

16. The apparatus of claim 15, wherein said feed section of said mixing assembly further comprises:

a horizontally-extending feed tube having an intake end in communication with said throat portion and a discharge end in communication with said mixing section; and a feed screw positioned within said feed tube for transporting said supply of cement dust from said intake end of said feed tube to said discharge end.

17. The apparatus of claim 16, wherein said mixing section of said mixing assembly comprises:

a horizontally-extending mixing chamber having an intake end in communication with said feed tube for receiving said metered supply of cement dust from said feed section;

nozzle means for injecting said metered supply of water into said mixing chamber proximate said intake end thereof; and agitator means positioned within said mixing chamber for combining said metered supplies of cement dust and water to form said initial cement slurry.

18. The apparatus of claim 17, wherein said agitator means comprises:

a lower trough portion for receiving said cement dust and water; and a plurality of mixing blades mounted to a horizontal drive shaft for rotating in and out of said trough portion so as to mix said water and cement dust, said mixing blades being angled so as to move said slurry from said intake end of said mixing chamber to a discharge end thereof.

19. The apparatus of claim 18, wherein said nozzle means comprises:

at least one nozzle member configured to direct said supply of water as a high-pressure jet in a direction from said intake end to said discharge end of said mixing chamber so as to assist in moving said slurry toward said discharged end thereof.

20. The apparatus of claim 19, wherein said at least one nozzle member comprises:

a plurality of nozzle members positioned at angularly and radially spaced distances about an upper side of said intake end of said mixing chamber so that said jet of water is configured as a fan of water across an upper side of said chamber which flushes said slurry downwardly into said trough portion thereof, and which also cleans the full length of each of said blade members proximate said intake end of said mixing chamber as said blades rotate through said upper side thereof.

21. The apparatus of claim 18, wherein said feed section further comprises:

a plurality of flight portions of said feed screw positioned in close-fitting relationship with said feed tube so as to separate said throat portion thereof from said intake end of said mixing chamber, so as to smooth out a flow of said cement dust through said feed section and so as to prevent water or slurry in said mixing chamber from backing up to said throat portion of said feed section.

22. The apparatus of claim 21, wherein said plurality of flight portions separating said throat portion from said intake end of said mixing chamber comprises at least three said flight portions.

23. A method for high capacity production of high-fluidity cement slurry which is substantially free of aggregate material, said method comprising the steps of:

providing a supply of hydraulic cement dust at an adjustable metered rate;

providing a supply of water at an adjustable, metered rate;

mixing said metered supply of cement dust with said metered supply of cement slurry to produce an initial cement slurry having a water-to-cement ratio which is precisely adjustable by adjusting said rates at which said water and cement dust are provided; and colloidally mixing said initial cement slurry so as to produce a high-fluidity colloidally-mixed hydraulic cement slurry having said precisely adjustable water-to-cement ratio and which is substantially free of aggregate material.

* * * * *